US009567829B2

(12) United States Patent
Pogoson et al.

(10) Patent No.: US 9,567,829 B2
(45) Date of Patent: Feb. 14, 2017

(54) DUAL BARRIER OPEN WATER COMPLETION

(71) Applicants: Eguaoje J. Pogoson, Humble, TX (US); Charles T. Kirkpatrick, New Caney, TX (US); Nicholas J. Clem, Houston, TX (US); Ian M. LeBlanc, Spring, TX (US); Jonathan N. Croy, Katy, TX (US); Andres Garcia, Houston, TX (US); Kenneth J. Chauvin, Spring, TX (US)

(72) Inventors: Eguaoje J. Pogoson, Humble, TX (US); Charles T. Kirkpatrick, New Caney, TX (US); Nicholas J. Clem, Houston, TX (US); Ian M. LeBlanc, Spring, TX (US); Jonathan N. Croy, Katy, TX (US); Andres Garcia, Houston, TX (US); Kenneth J. Chauvin, Spring, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 310 days.

(21) Appl. No.: 13/890,327

(22) Filed: May 9, 2013

(65) Prior Publication Data

US 2014/0332224 A1 Nov. 13, 2014

(51) Int. Cl.
*E21B 49/00* (2006.01)
*E21B 43/04* (2006.01)
(Continued)

(52) U.S. Cl.
CPC ..... *E21B 34/04* (2013.01); *E21B 33/129* (2013.01)

(58) Field of Classification Search
USPC ..... 166/74
See application file for complete search history.

(56) References Cited

U.S. PATENT DOCUMENTS 3,796,261 A * 3/1974 Nutter ..... 166/237
6,230,802 B1 * 5/2001 Duhon ..... E21B 28/00 166/117.6

(Continued)

OTHER PUBLICATIONS

Shell Exploration & Production, "Dual Down Hole Pressure Barrier System", Document No. 000-01-W-WE-7770-0002, Issue Date May 30, 2012, 7 pages.

(Continued)

*Primary Examiner* — Matthew R Buck
*Assistant Examiner* — Douglas S Wood
(74) *Attorney, Agent, or Firm* — Cantor Colburn LLP

(57) ABSTRACT

A method of completing a subsea borehole including connecting a first vessel to a subsea wellhead assembly via a riser. A borehole is drilled with a drill string communicated to the subsea wellhead assembly through the riser. A lower completion assembly is run on a service string into the borehole through the riser. At least two barrier valves of the lower completion assembly are set with the service string in order to form a mechanical barrier to fluid flow with each of the at least two barrier valves. The riser is disconnected from the subsea wellhead assembly. An upper completion string is run through open water to the borehole and connected to the lower completion assembly. An lower completion assembly for a subsea borehole is also included.

21 Claims, 6 Drawing Sheets

(51) Int. Cl.

| | |
|---|---|
| ***E21B 43/08*** | (2006.01) |
| ***E21B 23/00*** | (2006.01) |
| ***E21B 33/12*** | (2006.01) |
| ***E21B 34/04*** | (2006.01) |
| ***E21B 33/129*** | (2006.01) |

(56) References Cited

U.S. PATENT DOCUMENTS

| | | | | |
|---|---|---|---|---|
| 6,302,216 | B1 | 10/2001 | Patel | |
| 7,021,375 | B2 * | 4/2006 | Ringgenberg | E21B 21/002 166/186 |
| 7,438,135 | B2 * | 10/2008 | Page et al. | 166/387 |
| 9,062,530 | B2 * | 6/2015 | Patel | E21B 43/04 |
| 2006/0237189 | A1 | 10/2006 | Page et al. | |
| 2008/0105434 | A1 | 5/2008 | Orbell et al. | |
| 2012/0325484 | A1 | 12/2012 | Patel | |
| 2013/0075108 | A1 | 3/2013 | Frisby et al. | |
| 2015/0204155 | A1 * | 7/2015 | Patel | E21B 33/124 166/360 |

OTHER PUBLICATIONS

International Search Report and Written Opinion for PCT Application No. PCT/US2014/03134, dated Sep. 17, 2014, pp. 1-17.

* cited by examiner

DUAL BARRIER OPEN WATER COMPLETION

BACKGROUND

Subsea completions are known in the downhole drilling and completions industry. In subsea completions a drilling vessel is used to drill and complete a borehole. The drilling vessel connects at a subsea wellhead to the borehole via a riser, which is important for maintaining downhole fluid control with a column of fluid held in the riser. For this reason, the drilling vessel and riser remain in place until the borehole is fully completed and ready for production. The daily costs to operate a drilling vessel are very high and it can take a significant amount of time to finish the completion process. The industry would well receive methods and systems for reducing the cost to complete subsea wells.

SUMMARY

A method of completing a subsea borehole comprising connecting a first vessel to a subsea wellhead assembly via a riser; drilling a borehole with a drill string communicated to the subsea wellhead assembly through the riser; running a lower completion assembly on a service string into the borehole through the riser; setting at least two barrier valves of the lower completion assembly with the service string in order to form a mechanical barrier to fluid flow with each of the at least two barrier valves; disconnecting the riser from the subsea wellhead assembly; running an upper completion string through open water to the borehole; and connecting the upper completion string to the lower completion assembly.

A lower completion assembly for a subsea borehole, comprising a borehole originating at a subsea wellhead assembly; at least two barrier valves each forming a mechanical barrier to isolate the borehole when the at least two barrier valves are in a closed configuration; and a service string configured to shift the at least two barrier valves into the closed configuration without installation of an upper completion string to the lower completion assembly.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
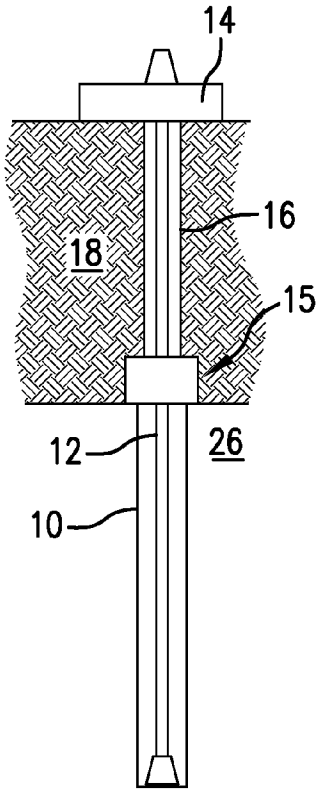
FIGS. 1-4 schematically illustrate a method of completing a borehole in which a drilling vessel and riser are moved off site after a lower completion assembly is installed in the borehole, but before the borehole is fully completed.

A detailed description of one or more embodiments of the disclosed apparatus and method are presented herein by way of exemplification and not limitation with reference to the Figures.

Referring now to FIGS. 1-4, a method for completing a subsea or open water (these terms being generally interchangeable as used herein) borehole according to one embodiment disclosed herein can be understood. The method includes drilling a borehole 10 with a drill string 12. The drill string 12 is suspended from a drilling vessel 14 and operated, e.g., via a drill rig on the vessel 14. The drilling vessel 14 is connected to a subsea wellhead assembly 15 for the borehole 10 via a riser 16 that extends through a body of water 18 between the vessel and the subsea wellhead assembly 15. The body of water 18 can be a lake, ocean, sea, gulf, etc., with the term "subsea" referring to any and all bodies of water. The wellhead assembly 15 can include or be coupled with a blowout preventer or other isolation devices, some or all of which may be changed or be swapped out for other components during the drilling and completion process. The drill string 12 is run through the riser 16, which may also include sea water, drilling mud, etc., for cooling the drill bit on the drill string 12, preventing the borehole 10 from collapsing, etc. After the borehole 10 has been drilled, other operations can be undertaken, such as cleaning, casing, lining, or cementing the borehole 10, among other operations in furtherance of completing the borehole 10. The borehole 10 may be cased or open hole or include both cased and open hole portions.

Figure 2:
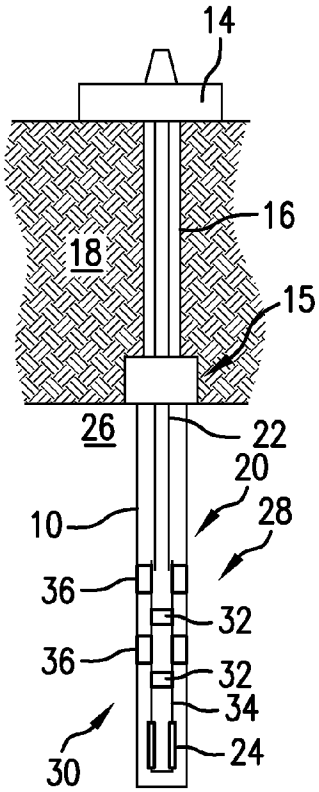

As illustrated by FIG. 2, a lower completion assembly 20 is next run into the borehole 10, e.g., via a service or work string 22. The lower completion assembly 20 can include one or more screens 24, e.g., for enabling the production of hydrocarbons through the screens 24 from a subterranean formation 26 located below the water 18.

The lower completion assembly 20 includes a pair of barriers 28 and 30. In the illustrated embodiment, the barriers 28 and 30 each include a barrier valve 32 for enabling isolation within a tubing string 34 of the lower completion assembly 20. As used herein, "barrier" or "mechanical barrier" is intended to indicate a device or devices that mechanically blocks or impedes the flow of fluid through or across the barrier. "Barrier valve" is intended to mean a device that is actuatable or operable, e.g., between open and closed configurations, to selectively form a mechanical barrier to fluid flow. The barriers 28 and 30 can each be paired with a packer 36 for sealing the annulus between the string 34 and the borehole 10.

Although the barrier valves 32 and the packers 36 form mechanical barriers, it is noted that this does not mean that the valves 32 and the packers 36 are set, actuated, or otherwise operated via mechanical manipulation. That is, as discussed in more detail below, the barrier valves 32 and the packers 36 can be operated mechanically, hydraulically, electrically, etc., or via any desired manner. In one embodiment, the barrier valves 28 and 30 are mechanically (e.g., via a setting tool) and hydraulically (e.g., via cycled tubing pressure) actuated ball valves, discussed in more detail below, although it is understood that other valves known in the art can be utilized. The packers 36 can take the form of any packer, or packing, sealing, anchoring, and/or isolating device known or used in the art.

Figure 3:
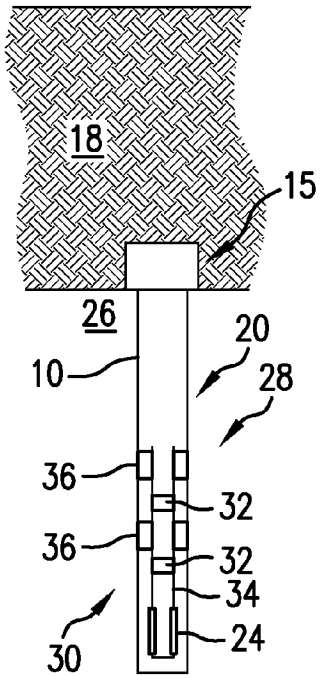
Figure 4:
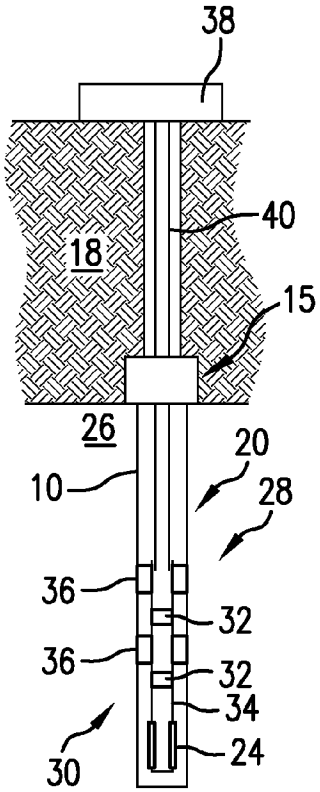

Creating a dual barrier system, e.g., having both the mechanical barriers 28 and 30, avoids the need to rely on the column of fluid in the riser 16 to hydraulically control fluid flow from the lower completion 20 and the formation 26. Advantageously, this enables the riser 16 to be retrieved and the drilling vessel 14 moved off site while the barriers 28 and 30 maintain fluid flow control, as depicted in FIG. 3. Thereafter, a utility vessel 38 can be brought in to finish completing the borehole 10 by running in an upper completion string 40 directly through the open water 18 (i.e., without the presence of a riser). For example, by upper completion string 40 it is meant a production string, artificial lift equipment such as electronic submersible pumps, etc., and any other components that are intended to be installed and used for or during production from the borehole 10.

Since drilling vessels are very expensive to operate, costs to complete the borehole 10 can be reduced by utilizing a relatively less expensive vessel, i.e., the utility vessel 38, to finish completing the borehole 10. The drilling vessel 14 and the riser 16 can also be immediately used for drilling and at least partially completing another borehole (e.g., miming a lower completion assembly, then moving offsite for another vessel to finish the completion process). The barriers 28 and 30 can then be removed, e.g., the barrier valves 32 and 34 opened, by cycling pressure through the upper completion string 40. Once opened, the borehole 10 is ready for production.

Figure 5:
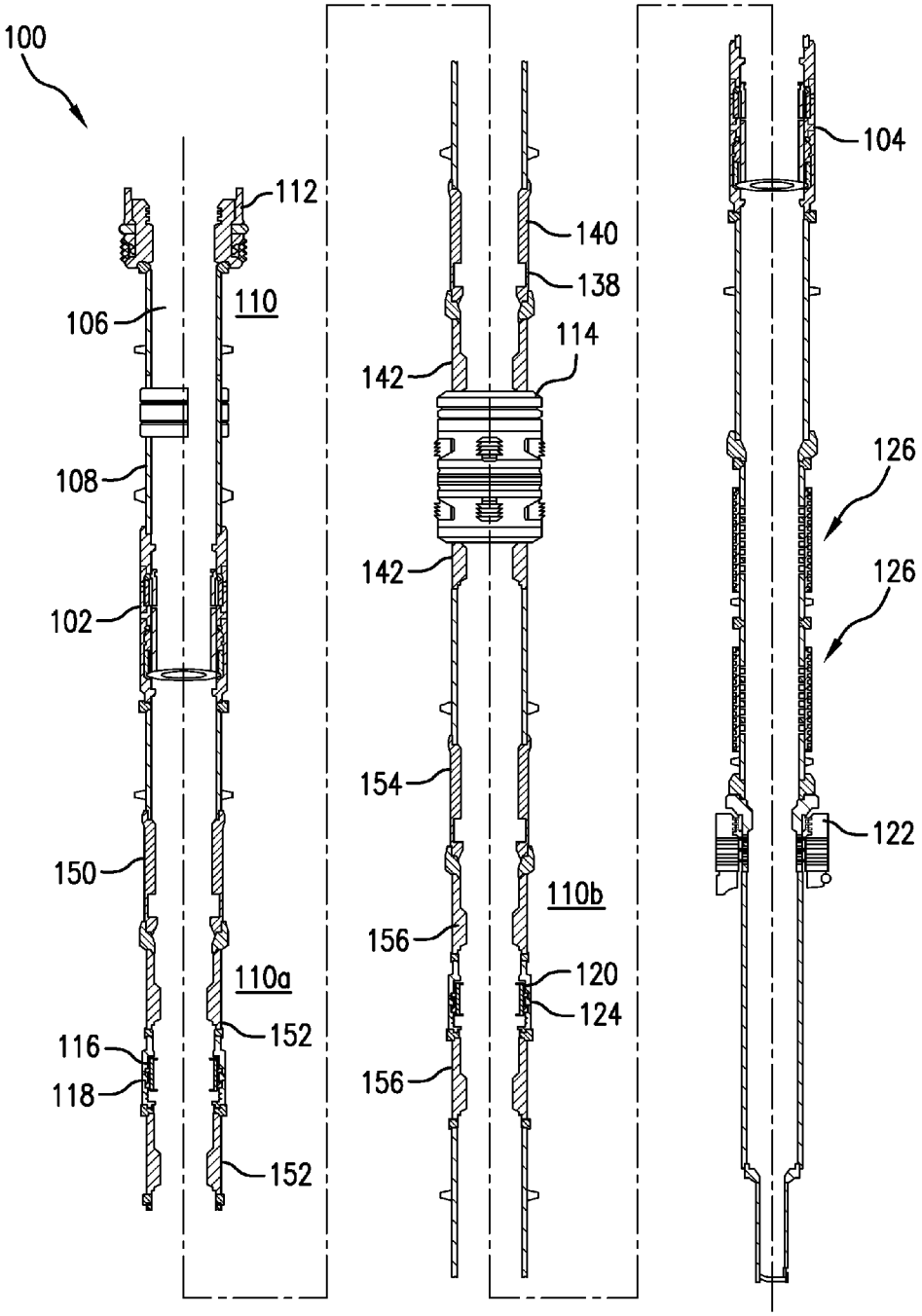
FIG. 5 is a partial cross-section of a lower completion assembly according to one embodiment disclosed herein.

A lower completion assembly 100 according to one embodiment is shown in FIG. 5. It is to be understood that the lower completion assembly 100 is generally intended to be utilized in a manner akin to that discussed above with respect to the lower completion assembly 20. Various structural similarities between the assemblies 100 and 20 will also be observed and appreciated in view of the below discussion. For example, the lower completion assembly 100 includes a pair of barrier valves 102 and 104 for selectively impeding fluid flow through an interior passageway 106 of a lower completion string 108. In the illustrated embodiment, the barrier valves 102 and 104 are ball valves that are configured to be mechanically closed and hydraulically cycled open. In one embodiment, the ball valves are commercially available from Baker Hughes Incorporated as Model RB™ isolation valves.

In order to seal an annulus 110 between the lower completion assembly 100 and the borehole in which it is run, an upper packer 112 and a lower packer 114 can also be included. In one embodiment, the packer 112 is commercially available from Baker Hughes Incorporated as an SC-XP™ packer, and the packer 114 is a so-called "premier" isolation packer. The packers 112 and 114 can include suitable slips and/or sealing elements for enabling the packers 112 and 114 to anchor and/or seal the lower completion assembly 100 within its corresponding borehole, e.g., the borehole 10. Those with knowledge in the art will appreciate that other valves, packers, and sealing devices can be utilized in lieu of those discussed and illustrated for creating mechanical barriers to fluid flow.

The lower completion assembly 100 includes an upper sleeve 116 for selectively enabling fluid communication between the interior passageway 106 of the string 108 and a portion 110*a* of the annulus 110 isolated between the packers 112 and 114 via one or more ports 118. Selectively opening and closing the ports 118 with the sleeve 116 can be employed, for example, to circulate fluid for testing the packers 112 and 114 or other components of the lower completion 100 for leaks. In one embodiment, a gauge 119 is included for monitoring the temperature and/or pressure of the fluid within the interior passageway 16 and the annulus portion 20*a*. By gauge it is meant any combination of sensors or sensing devices. Comparing the results measured by the gauge 119 in both locations enables determinations as to the integrity of the packers 22 and 24 to be made, i.e., whether leaks exists through the packers.

A lower sleeve 120 can be included to selectively enable fluid communication between the interior passageway 106 and a portion 110*b* of the annulus 110 isolated between the packer 114 and a sump packer 122 via one or more ports 124. Selectively opening and closing the port 124 with the lower sleeve 120 can be used for testing packers and valves or other components of the assembly 100, similar to the sleeve 116 and the port 118. Additionally, the portion 110*b* of the annulus 110 is in communication with one or more screen assemblies 126 of the lower completion assembly 100. The screen assemblies 126 could include slots, wire wraps, mesh, bead packs, permeable foam, or any other filtering media or configuration known or used in the art for impeding the flow of solid particles, e.g., sand, into the assembly 100 while permitting the flow of fluids such as hydrocarbons. In this way, the sleeve 120 and the port 124 can be utilized for stimulating or treating the portion 110*b* of the annulus 110 and/or the downhole formation located contiguous to the portion 110*b* (e.g., the formation 26). For example, operations such as gravel or frac packing, hydraulic fracturing, acidizing, or other formation treatments can be carried out via the port 124 when the sleeve 120 is moved to an open position. By shifting the sleeve 120 to its closed position and closing the port 124, fluids from the formation, e.g., hydrocarbons, can be filtered by the screen assemblies 126 and produced through the interior passageway 106 of the string 108.

Figure 6:
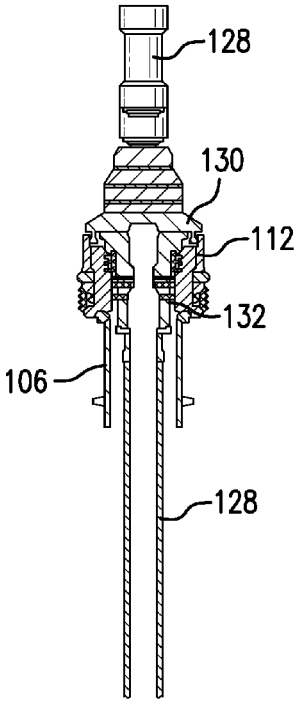
FIG. 6 is a partial cross-section of a portion of a service string for running-in and manipulating the lower completion assembly of FIG. 5.

Similar to the schematic embodiment of FIG. 1, the lower completion assembly 100 can be arranged for run-in on a service or work string. FIG. 6 is a partial view of the lower completion assembly 100 and a service string 128, configured with a coupling 130 to enable run-in and positioning of the assembly 100. For example, the service string 128 can be used to land the assembly 100 in a sump packer, e.g., the sump packer 122, in a borehole, e.g. the borehole 10. Those of ordinary skill in the art will recognize that the assembly 100 may be snapped out and back into the sump packer 122 to verify location of the assembly 100 within the borehole and/or pick up and set down weight determined before snapping in. After locating the assembly 100 in the sump packer 122, the assembly 100 can be pressured up to hydraulically set the upper packer 112. One or more seal elements 132 can be disposed between the service string 128 and the lower completion string 108 for isolating the interior passageway 106 from the service string 128.

Figure 7:
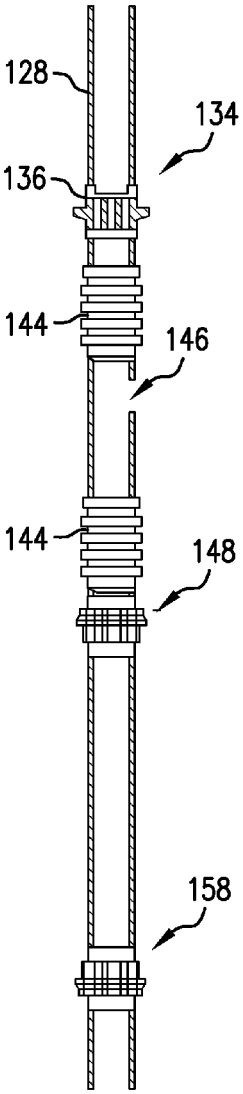
FIG. 7 is a partial cross-section of a portion of the service string of FIG. 6 having a tool for manipulating components of the lower completion assembly.
Figure 8:
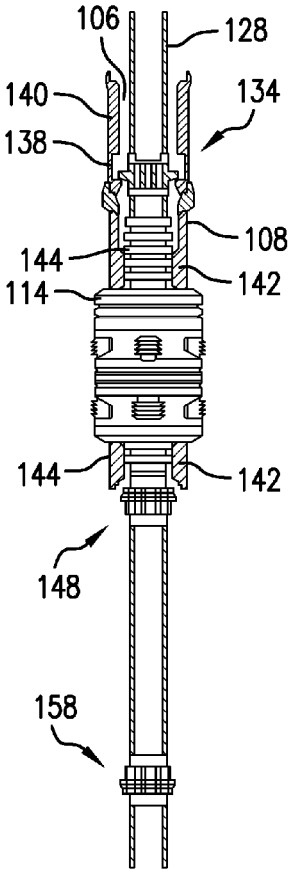
FIG. 8 is a partial cross-section of a packer of the lower completion assembly of FIG. 5 being set by the tool of the service string of FIG. 7.

After setting the upper packer 112, the service string 128 can be picked up to release the assembly 100 at the coupling 130. This enables a service tool 134 of the service string 128, shown in FIG. 7, to be positioned with respect to the lower completion assembly 100 for enabling manipulation of the components of the lower completion assembly 100, as discussed in more detail below. For example, as illustrated in FIG. 8, after setting the upper packer 112 and releasing the coupling 130, a locator device 136 of the service tool 134 can be engaged with a corresponding recess 138 of a locator sub 140 for locating the tool 134 within the assembly 100. In one embodiment, the locator device 136 is arranged to selectively engage with the sub 140 when slacking off on the work string 128 to set down the tool 134 in the downhole direction. The locator device 136 can be any suitable indexing device, smart collet, indicating collet, autolocator, etc., known or used in the art. It is also to be appreciated that the locator device 136 can be, or be replaced by, a locator device that lands at a radial restriction, instead of having radially extendable fingers, as illustrated.

The locator sub 140 in the illustrated embodiment corresponds with the lower packer 114 and a pair of seal bore subs 142 adjacent to the lower packer 114. When the locating device 136 is located at the locator sub 140, a pair of seal members 144 engages respectively with the seal bore subs 142. By isolating on opposite sides of the lower packer 114 with the seal members 144 in the seal bores 142, the lower packer 114 can be hydraulically set via high pressure fluid communicated to the lower packer 114 via a port or ports 146 (see FIG. 7) located between the seal members 144 in the work string 128.

Figure 9:
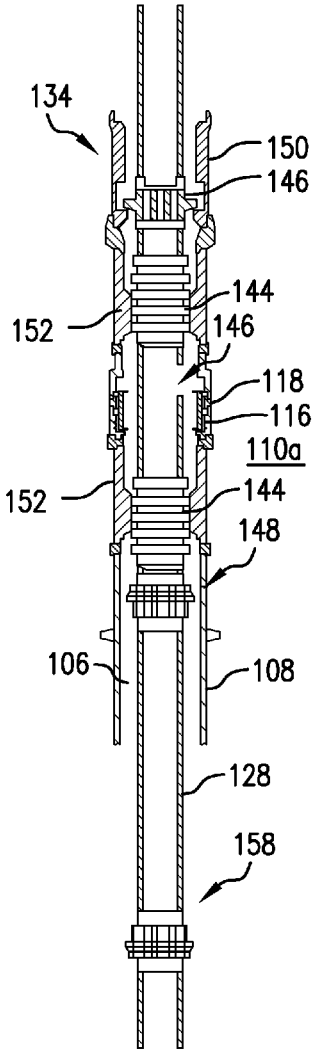
FIG. 9 is a partial cross-section of an upper sleeve of the lower completion assembly of FIG. 5 being actuated by the tool of the service string of FIG. 7.
Figure 10:
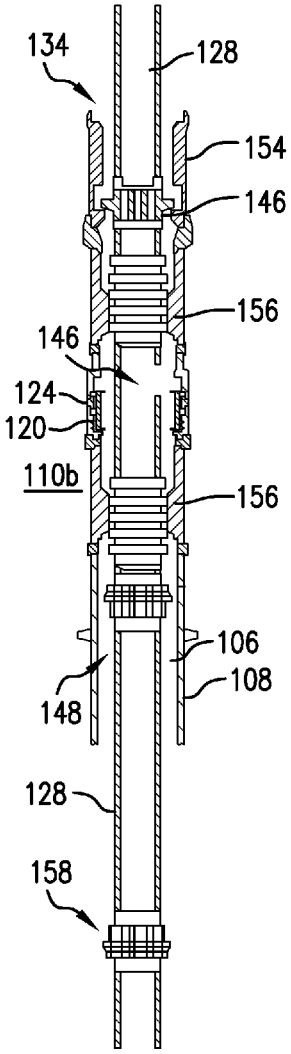
FIG. 10 is a partial cross-section of a lower sleeve of the lower completion assembly of FIG. 5 being actuated by the tool of the service string of FIG. 7.

After setting the lower packer 114, the work string 128 can continue to be picked up past the upper sleeve 116 and then moved back downhole to enable a shifting tool 148 to engage and shift the upper sleeve 116 to open the ports 118. In one embodiment the shifting tool 148 includes collet fingers, retractable dogs, etc. that are arranged to enable the tool 148 to be moved past a device (e.g., the sleeve 116) in one direction (e.g., the uphole direction with respect to the illustrated embodiment), but to engage and actuate the device (e.g., the sleeve 116) when moving in the opposite direction. The locating device 136 will land at a locating sub 150 with the sleeve 116 in its opened configuration, as illustrated in FIG. 9.

The sub 150 generally resembles the sub 140 in structure and function, but is arranged to locate the work string 128 with respect to the upper sleeve 116. Similar to the locating sub 140, the sub 150 is arranged with respect to a pair of seal bores 152 that are aligned with the seal members 144 when the tool 134 is located by the device 136 at the sub 150. In this configuration, the work string 128 is in fluid communication with the annulus portion 110*a*, but isolated from the passageway 106 via the engagement of the seal members 144 in the seal bores 152. For example, this enables the integrity of the packers 112 and 114 defining the annulus portion 110*a* to be tested, e.g., by pressuring up fluid within the work string 128 and monitoring the results.

The work string 128 can be picked up to release the locating device 136 from the sub 150 and to cycle the device 136 to enable the tool 134 to pass downhole by the sub 150 without engagement. Moving the string 128 further downhole will cause the locator device 136 to land at a locating sub 154 as illustrated in FIG. 100. The sub 154 is generally similar to the subs 140 and 150, but positioned to locate the tool 134 with respect to the lower sleeve 120. While traveling downhole to the sub 154, the shifting tool 148 of the tool 134 will open port 124 by shifting the sleeve 120, similar to the operation of the sleeve 116 discussed above. Also similar to the subs 140 and 150, the locating sub 154 is associated with a pair of seal bores 156 that are sealingly engagable with the seal members 144 when the locator device 136 is located at the sub 154. This isolates the work string 128 from the interior passageway 106 of the string 108, but permits fluid communication between the work string 128 and the annulus portion 110*b*. Specifically, the port(s) 146 are aligned with the ports 124 of the sleeve 120, which was opened while moving the tool 134 into position. For example, since the annulus portion 110*b* contains the screen assemblies 126, a fluid treatment or stimulation operation related to eventual production of the downhole assembly can be performed by pumping a desired fluid down the service string 128. The operation can include chemical injection, acidizing, hydraulic fracturing, pumping slurry for a gravel or frac pack, etc.

Figure 11:
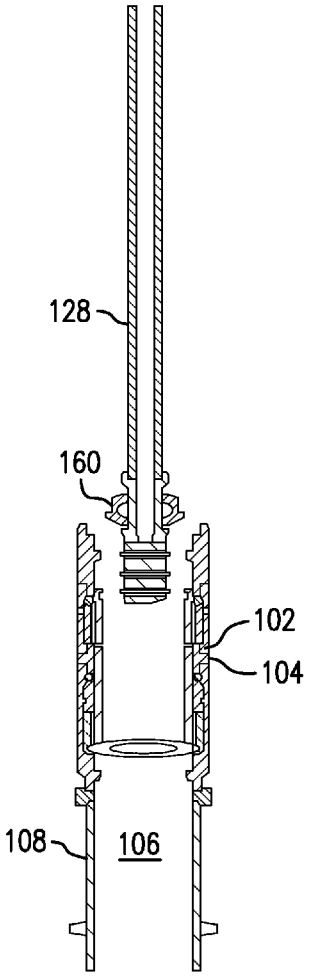
FIG. 11 is a partial cross-section of a barrier valve of the lower completion assembly of FIG. 5 being closed by the tool of the service string of FIG. 7.

After the desired treatment has been performed, the work string 128 can be removed from the borehole. The tool 134 can include a shifting tool 158 configured similarly to the shifting tool 148, but to engage and actuate devices or components in a direction opposite to that of the tool 148, e.g., in the uphole direction as the work string 128 is pulled out. At a distal end of the work string 128, a closing tool 160, shown in FIG. 11, can be included for engaging with and closing the barrier valves 102 and 104. In this way, pulling out the work string 128 after treatment will automatically isolate the lower completion with both barrier valves 102 and 104 in order to provide two mechanical barriers to fluid flow. In this way, the barrier valves 102 and 104 assume the role of the barriers 28 and 30 discussed with respect to FIGS. 1-4. As noted above, the vessel from which the work string 128 is operated, e.g., the drilling vessel 14, can be moved off site and used for completing another borehole. Additionally, the well can be completed and hydrocarbons produced without the need for a riser, e.g., the riser 16, which can also be moved off site and used for another job. Once the borehole is ready to be fully completed and hydrocarbons produced therefrom, another vessel, e.g., the utility vessel 38, can be moved on site and connected to the lower completion via a production or upper completion string, e.g., the string 40.

Figure 12:
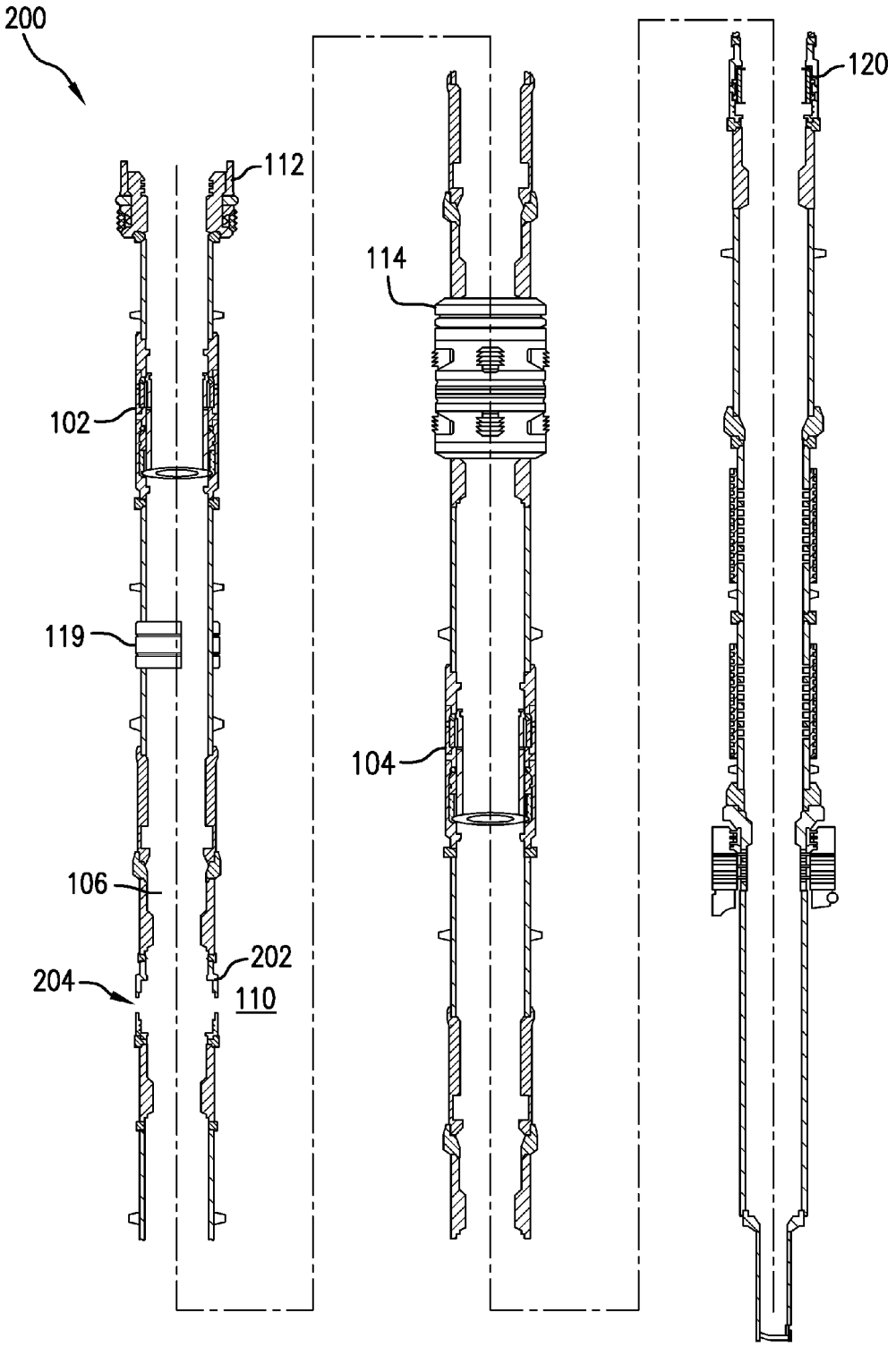
FIG. 12 is a partial cross-section of a lower completion assembly according to one embodiment disclosed herein.

A lower completion assembly 200 according to one embodiment is depicted in FIG. 12. The assembly 200 resembles the assembly 100 in many respects, with like-components generally sharing the same reference numerals, structure, and function as the components of the assembly 100. In lieu of the upper sleeve assembly 116 of the assembly 100, the assembly 200 includes a ported sub 202 having one or more ports 204. The ported sub 202 essentially acts as the sleeve 116 when in the open position, in that the ports 204 enable fluid communication between the interior passageway 106 and the annulus 110. The inclusion of the ported sub 202 can eliminate the need to manipulate the work string 38 and the tool 44 to open and the close the sleeve 116 during the completion process, potentially saving time and reducing complexity. However, as the passageway 106 is always open to the annulus 110, the ability of the gauge 119 to accurately detect the location of leaks may be negatively affected.

Another potential modification to the assembly 100 that can be appreciated in view of the assembly 200 is that the relative placement of the barrier valves 102 and 104 can be altered if desired. That is, by comparing the assemblies 100 and 200 it can be seen that the upper barrier valve 102 of the system 200 is repositioned between the upper packer 112 and the gauge 119, while the lower barrier valve is repositioned between the lower packer 114 and the lower sleeve 120. Repositioning the lower barrier valve 104 uphole of the lower sleeve 120 may facilitate the ability of the completion 200 to be "V0" rated, as the lower sleeve 120 may undergo erosion or structural deterioration due to the flow of proppant or slurry therethrough during fracturing, gravel packing, etc. It is of course to be appreciated that combinations of the assemblies 100 and 200 are also possible and within the scope of this disclosure and the claims. For example, in one embodiment the lower completion assembly includes a lower barrier valve located uphole of a lower sleeve assembly (similar to the assembly 200) and also has an upper sleeve assembly (similar to the assembly 116 of the assembly 100). In one embodiment, the lower completion assembly includes a lower barrier valve located downhole of a lower sleeve assembly (similar to the assembly 100) and also has a ported sub in lieu of an upper sleeve assembly (similar to the ported sub 202 of the assembly 200).

Figure 13:
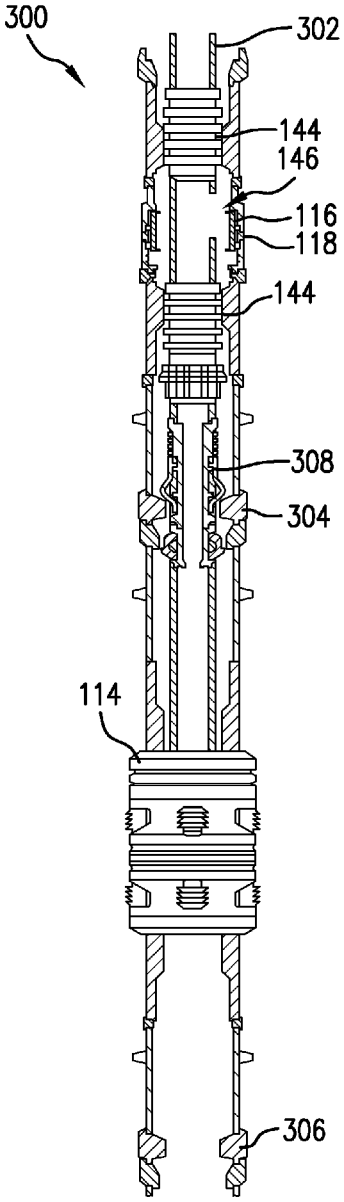
FIG. 13 is a partial cross-section of a portion of a lower completion assembly and corresponding service string according to one embodiment disclosed herein.

A portion of a lower completion assembly 300 is shown in FIG. 13 along with a modified service string 302. The assembly 300 generally resembles the assemblies 100 and/or 200, with like-components sharing reference numerals, except that the recessed locating subs (e.g., the subs 140, 150, and 154) of the assemblies 100 and 200 are replaced with locating subs taking the form of radially restricted indicating couplings. That is, the assembly 300 is illustrated having locating subs 304 and 306, although the assembly 300 may include additional locating subs as needed. Accordingly, the modified service string 302 generally resembles the service string 128 with the exception that the string 302 includes a locator device 308 in lieu of the locator device 136 that is adapted to land at the radial restrictions formed by the subs 304 and 306. Additionally, it is noted that the subs 304 and 306 are located in a downhole direction of their corresponding components, i.e., downhole of the sleeve 116 and the lower packer 114, respectively. The locator device 308 can include an indexing or counting mechanism, e.g., utilizing a J-slot configuration, to enable the work string 302 to selectively land at and/or pass by restrictions of the subs 304, 306, and/or others as the string 302 is manipulated within the assembly 300.

Figure 14:
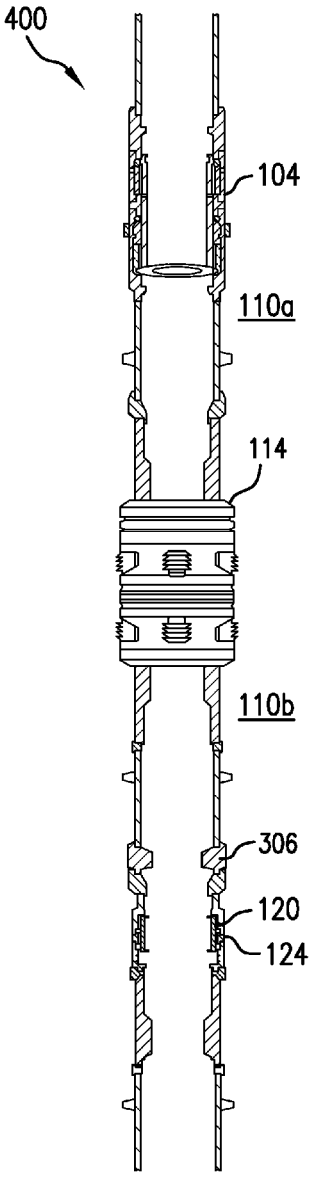
FIG. 14 is a partial cross-section of a portion of a lower completion assembly according to one embodiment disclosed herein.

A portion of a lower completion assembly 400 is shown in FIG. 14. The assembly 400 generally resembles the assembly 300 in that it includes indicating couplings, such as the locating sub 306 for the lower packer 114, although it is to be appreciated that recessed locating subs, e.g., similar to the sub 140, could alternatively be used. The assembly 400 differs from the assemblies 100, 200, and 300 in that the lower barrier valve 104 is positioned uphole of the lower packer 114. The arrangement of the assembly 400 may be used, for example, if it is desired to place both barrier valves within the annulus portion 110*a*, thereby isolating the barrier valve 104 from the treatment operation that occurs through the ports 146. It is again to be appreciated that combinations of the features and/or components of the assemblies 100, 200, 300, and/or 400 could be made and utilized in order to accommodate or address design considerations for various borehole completion jobs and that the particular embodiments illustrated and disclosed herein are given as some examples only.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of completing a subsea borehole comprising:

connecting a first vessel to a subsea wellhead assembly via a riser;

drilling a borehole with a drill string communicated to the subsea wellhead assembly through the riser;

running a lower completion assembly on a service string into the borehole through the riser, the lower completion assembly including a tubular string having an uphole end portion spaced from the wellhead assembly and, at least two barrier valves arranged within the tubular string;

setting the at least two barrier valves arranged within the tubular string of the lower completion assembly with the service string prior to running an upper completion string in order to form a mechanical barrier to fluid flow with each of the at least two barrier valves;

disconnecting the riser from the subsea wellhead assembly;

running the upper completion string through open water to the borehole; and connecting the upper completion string to the lower completion assembly.

2. The method of claim 1, further comprising setting an upper packer and a lower packer of the lower completion assembly with the service string in order to isolate an annulus between the borehole and a lower completion string of the lower completion assembly.

3. The method of claim 2, wherein one of the at least two barrier valves is in a first portion of the annulus between the upper packer and the lower packer and another of the at least two barrier valves is in a second portion of the annulus defined at least partially by the lower packer and opposite from the first portion.

4. The method of claim 2, wherein both of the at least two barrier valves are located in a first portion of the annulus defined between the upper packer and the lower packer, and wherein a second portion of the annulus located opposite the first portion with respect to the lower packer includes one or more screen assemblies.

5. The method of claim 2, further comprising testing the upper and lower packers with the service string.

6. The method of claim 5, wherein testing the upper and lower packers further comprises monitoring a pressure of the fluid with a pressure gauge.

7. The method of claim 5, wherein testing the upper and lower packers includes:

positioning a pair of seal members of the service string with a corresponding pair of seal bores of the lower completion assembly, the seal members located on opposite sides of one or more first ports in the service string and the seal bores located on opposite sides of one or more second ports in the lower completion assembly; and communicating a fluid through the service string into the annulus via the one or more first and second ports.

8. The method of claim 7, further comprising shifting a sleeve with the service string in order to open one or more second ports before communicating the fluid.

9. The method of claim 7, wherein positioning the pair of seal members includes landing a locating device of the service string at a corresponding locating sub of the lower completion assembly.

10. The method of claim 1, further comprising performing a treatment or stimulation operation on the borehole with the service string.

11. The method of claim 10, wherein the treatment or stimulation includes gravel packing, frac packing, hydraulic fracturing, chemical injection, acidizing, or a combination including at least one of the foregoing.

12. The method of claim 11, further comprising shifting a sleeve with the service string in order to open one or more first ports in the lower completion assembly, and wherein performing the treatment or stimulation operation includes communicating a fluid through the service string to an annulus between the lower completion assembly and the borehole via the one or more first ports and one or more second ports in the service string.

13. The method of claim 1, wherein setting the at least two barrier valves includes shifting the at least two barrier valves closed with a closing tool on the service string as the service string is pulled out of the borehole.

14. The method of claim 1, further comprising opening the at least two barrier valves after connecting the upper completion string to the lower completion assembly.

15. The method of claim 14, wherein opening the at least two barrier valves includes pressurizing fluid within the upper completion string and lower completion assembly to cycle open the at least two barrier valves.

16. The method of claim 14, further comprising producing hydrocarbons from the borehole through the upper completion string from the lower completion assembly.

17. The method of claim 1, wherein the upper completion string is run from a second vessel.

18. A lower completion assembly for a subsea borehole originating at a subsea wellhead, the lower completion assembly comprising:

a continuous tubular string extending into the borehole, the continuous tubular sting including an uphole end portion spaced from the subsea wellhead assembly, the continuous tubular string forming, at least in part, the lower completion assembly;

at least two barrier valves arranged within the continuous tubular string, each of the at least two barrier valves forming a mechanical barrier to isolate the borehole when the at least two barrier valves are in a closed configuration; and a service string configured to shift the at least two barrier valves into the closed configuration without installation of an upper completion string to the uphole end portion of the tubular string of the lower completion assembly.

19. The assembly of claim 18 further comprising at least two packers for isolating an annulus between a lower completion string of the lower completion assembly and the borehole.

20. The assembly of claim 19, further comprising a sleeve movable between an open position at which fluid communication is permitted between the annulus and an interior passageway of the lower completion string via one or more first ports, and a closed position at which fluid communication is not permitted through the one or more first ports.

21. The assembly of claim 20, wherein the service string includes a shifting tool that selectively moves the sleeve between the open and closed positions and least one second port for providing fluid communication between the service string and the annulus via the one or more first and second ports when the sleeve is in the open position.

* * * * *